US007125465B2

(12) United States Patent
Bullard

(10) Patent No.: US 7,125,465 B2
(45) Date of Patent: Oct. 24, 2006

(54) METHOD OF MAKING RESILIENT STRUCTURE INCLUDING INSERTING HEATED COIL SPRING THROUGH SIDE SURFACE OF FIBER BATT

(75) Inventor: Larry I. Bullard, Winston Salem, NC (US)

(73) Assignee: L & P Property Management Company, South Gate, CA (US)

( * ) Notice: Subject to any disclaimer, the term of this patent is extended or adjusted under 35 U.S.C. 154(b) by 197 days.

(21) Appl. No.: 10/752,372

(22) Filed: Jan. 6, 2004

(65) Prior Publication Data

US 2004/0140046 A1 Jul. 22, 2004

Related U.S. Application Data

(62) Division of application No. 10/127,004, filed on Apr. 19, 2002, now Pat. No. 6,694,554.

(60) Provisional application No. 60/285,585, filed on Apr. 20, 2001, now abandoned.

(51) Int. Cl.
*B29C 65/02* (2006.01)
*B29C 65/44* (2006.01)

(52) U.S. Cl. ..... 156/182; 156/266; 156/303.1; 156/309.9

(58) Field of Classification Search ..... 156/252, 156/303.1, 309.6, 309.9, 322, 182, 266; 5/716–721, 655.7, 655.8; 297/452.51
See application file for complete search history.

(56) References Cited

U.S. PATENT DOCUMENTS 590,328 A 9/1897 Muller
2,385,870 A * 10/1945 Lashar et al. ..... 156/252
2,874,389 A 2/1959 Koenigsberg
3,618,146 A * 11/1971 Ferdinand ..... 5/717
3,806,576 A 4/1974 Richardson et al.
3,822,426 A * 7/1974 Mistarz ..... 5/717
3,837,985 A 9/1974 Chase
4,136,275 A 1/1979 McCullough
4,439,977 A 4/1984 Stumpf
4,686,753 A 8/1987 Zapletal et al.
4,811,439 A 3/1989 Siegel et al.
4,854,023 A 8/1989 Stumpf
4,862,540 A 9/1989 Savenije
5,079,074 A 1/1992 Steagall et al.
5,126,004 A 6/1992 Suenens et al.
5,327,596 A 7/1994 Wallace et al.
5,572,853 A * 11/1996 St. Clair et al. ..... 53/440
5,741,380 A 4/1998 Hoyle et al.
5,746,877 A 5/1998 Notheis et al.
5,749,133 A 5/1998 Mauldin et al.

(Continued)

FOREIGN PATENT DOCUMENTS

EP 0013967 8/1980

(Continued)

*Primary Examiner*—Steven D. Maki
(74) *Attorney, Agent, or Firm*—Wood, Herron & Evans, L.L.P.

(57) ABSTRACT

A resilient structure having a fiber batt with coil springs disposed therein and respective coil spring paths. Each of the coil spring paths extending from a respective coil spring and having a profile similar to a cross-sectional profile of the respective coil spring taken in a plane parallel to a length of the coil spring. A method is also provided for heating the coil springs and inserting the coil springs into a side wall of the fiber batt to produce the coil spring paths that have a profile similar to a cross-sectional profile of the respective coil spring taken in a plane parallel to a length of the coil spring.

3 Claims, 9 Drawing Sheets

U.S. PATENT DOCUMENTS

| | | | | | |
|---|---|---|---|---|---|
| 5,792,309 | A | | 8/1998 | Eto | |
| 5,988,253 | A | | 11/1999 | Eto | |
| 6,021,627 | A | * | 2/2000 | Mossbeck et al. | 5/655.8 |
| 6,077,378 | A | | 6/2000 | Bullard et al. | |
| 6,119,322 | A | | 9/2000 | Eto | |
| 6,155,310 | A | | 12/2000 | Haubert et al. | |
| 6,175,997 | B1 | | 1/2001 | Mossbeck | |
| 6,295,673 | B1 | * | 10/2001 | Mossbeck | 5/655.8 |
| 6,315,275 | B1 | | 11/2001 | Zysman | |

FOREIGN PATENT DOCUMENTS

| | | | |
|---|---|---|---|
| JP | 5-56829 | | 3/1993 |
| JP | 8-196381 | * | 8/1996 |
| WO | WO 94/18872 | * | 9/1994 |

* cited by examiner

METHOD OF MAKING RESILIENT STRUCTURE INCLUDING INSERTING HEATED COIL SPRING THROUGH SIDE SURFACE OF FIBER BATT

This application is a Divisional of U.S. Ser. No. 10/127,004, filed on Apr. 19, 2002, now U.S. Pat. No. 6,694,554 which claims the benefit of Provisional Application Ser. No. 60/285,585, filed on Apr. 20, 2001, all of which are hereby expressly incorporated by reference herein.

FIELD OF THE INVENTION

This invention relates to a resilient structure such as a seat cushion, furniture back or mattress. More particularly, this invention relates to a resilient structure comprising a fiber batt having enhanced resilience and/or support in strategic areas.

BACKGROUND OF THE INVENTION

Non-woven fiber batt has a demonstrated usefulness in a wide variety of applications. This material has been used in manufacturing scouring pads, filters, and the like, but is particularly useful as a filler material in various personal comfort items such as stuffing in furniture, mattresses and pillows, and as a filler and insulation in comforters and other coverings. One of the inherent characteristics of fiber batt is its cushioning ability due to the large amount of air space held within the batt material. The air space defined within the fiber batt acts as a thermal insulation layer, and its ready displaceability allows support in furniture, mattresses and pillows.

Typically, the fiber batt is produced from a physical mixture of various polymeric fibers. The methods for manufacturing the batt are well known to those skilled in the art. Generally, this method comprises reducing a fiber bale to its individual separated fibers via a picker, which "fluffs" the fibers. The picked fibers are homogeneously mixed with other separated fibers to create a matrix which has a very low density. A garnet machine then cards the fiber mixture into layers to achieve the desired weight and/or density. Density may be further increased by piercing the matrix with a plurality of needles to drive a portion of the retained air therefrom.

A resilient structure such as a seat, a furniture back or a sleeping surface must be able to support a given load, yet have sufficient resilience, or give, to provide a degree of comfort. For these structures, a heat bonded, low melt fiber batt may be used to form an inner core, or as a covering. To provide the necessary support, a certain fiber density must be built into the fiber batt. If the fiber density is too high, the seat cushion or mattress will have sufficient rigidity but it will be too firm. If the fiber mass is less dense, it will be more comfortable. However, it will not be as durable and will be more susceptible to flattening out after use. Thus, while fiber batting has a number of well-recognized advantages, it is difficult to achieve a high degree of structural support and/or comfort for a resilient structure with a covering or core made from a heat bonded low melt fiber batt.

To minimize these limitations, it is common to combine a fiber batt with an interconnected wire lattice. For instance, mattresses often include a wire lattice sandwiched between two layers of fiber batting. The wire lattice provides a high degree of structural rigidity. Resiliency can be built into the wire lattice by including coil or leaf springs at various locations. To do this, the lattice may include a plurality of internal coils interconnected by border wire and anchoring springs. While a resilient structure with an interconnected wire lattice of this type has many desirable features, it requires a relatively large quantity of steel. Moreover, its manufacture and construction also requires relatively complex machinery to form and interconnect the steel. The overall cost of a typical resilient mattress of this type reflects the relatively high quantity of steel used to make the support lattice and the complexity of the required machinery.

An alternative construction is known which does not have the disadvantages of the above wire lattice. With the alternative construction, a heat bonded, low melt, fiber batt is initially formed. Thereafter, heated coil springs are screwed through the thickness of the heat bonded, low melt, fiber batt at predetermined positions. The heated coil springs melt some or all of the immediately surrounding low melt fibers. As the melted fibers resolidify or cure, they interlock with the coil springs to hold and encapsulate the coil springs in place within the fiber batt. The fiber batt may be compressed after insertion of the springs, or while the springs are still hot, and until curing is completed.

If the coil springs are unknotted and have a constant diameter throughout their length, threading the coils through the thickness of the fiber batt from a top or bottom surface presents minimal breakage and disruption to the fiber strands. Each successive turn travels along substantially the same path as a prior turn, so that fiber strand damage in the fiber batt is minimal. However, as the heated coil spring is threaded through the fiber batt, the leading turn of the coil spring quickly cools and will cool below the melt temperature of the fiber strands before it is threaded completely through the thickness of the fiber batt. In that event, fiber strands resolidify on the cooled coil; and as the threaded insertion of the coil continues, the solidified fiber strands thereon tear away from their adjacent fiber strands. That process diminishes the integrity of the fiber batt at the location of the tear, and further, any fiber strand tearing prohibits the coil spring from interlocking with its immediately surrounding fiber strands.

The known coil threading process has another significant disadvantage. In some applications, it is desirable to use coil springs having turns of different diameters over the length of the coil spring. However, as the variable diameter coil spring is threaded through the thickness of the fiber batt, a smaller diameter turn cannot travel along the same path as a larger diameter turn. Therefore, variable diameter coil springs cannot practically be threaded through the thickness of the fiber batt.

In other applications, it may be desirable to use coil springs in which the ends of a coil are knotted to the end turns. With such a coil, threading of the coil through the fiber batt is not possible. Therefore, for all practical purposes, knotted coil springs cannot be used.

It is also known to cut a plurality of intersecting slit patterns in the fiber batt, from one side thereof. Preferably, each intersecting slit pattern has two slits which define a cross shape. The springs are then inserted into the slit patterns until the endmost turns of the springs lie flush with or slightly above the top and bottom surfaces of the batt. Preferably, variable diameter, knotted type springs are used, and the wedge-shaped segments of fiber batt created by the cross-shaped slits fill in between the turns of each spring to interlock the spring in the batt without the necessity of heating and cooling the batt and/or spring. However, heat and compression and/or heating, cooling and compression may be applied to the fiber batt, as described previously, before or after the additional layers are placed on the batt.

The above described embodiment of inserting a coil spring into a slit in the fiber batt also has disadvantages. First, cutting slits through the thickness of the fiber batt cuts a substantial number of fiber strands through the thickness; and as described above, substantially weakens the resiliency and load carrying capability of the fiber batt. The process of slitting the fiber batt requires extra tooling and a processing station as part of the manufacturing process. That tooling and processing station also requires maintenance; and therefore, they add significant cost to the manufacturing process.

Thus, the known processes of threading a coil spring through a fiber batt and slitting a fiber batt for coil insertion have significant limitations and disadvantages. Therefore, there is a need to provide a resilient structure in which coil springs are inserted into a fiber batt without the above disadvantages.

SUMMARY OF THE INVENTION

The present invention provides an improved, more durable and higher quality resilient structure comprised of coil springs located inside a fiber batt. With the resilient structure of the present invention, the coil springs are disposed in the fiber batt with a minimal amount of melt impact to the fiber strands in the fiber batt. Further, the resilient structure of the present invention has fiber strands interlayered with the turns of the coil spring. Thus, the resilient structure of the present invention has the advantages of improved strength and support characteristics, improved coil spring support within the fiber batt, less susceptibility to coil spring noise, a reduction in compression loss and a reduction in coil spring fatigue that increases the durability of the structure. The resilient structure of the present invention is especially useful as a foundation that can be used in cushions, mattresses, etc.

According to the principles of the present invention and in accordance with the described embodiments, the invention provides a resilient structure made of a fiber batt having a coil spring disposed therein. The fiber batt further has a coil spring path extending from the coil spring and having a profile similar to a cross-sectional profile of the coil spring taken in a plane parallel to a longitudinal centerline of the coil spring.

In another embodiment, the invention provides a resilient structure made of a first fiber batt strip having first coil springs disposed therein along with first coil spring paths extending from respective first coil springs. Each of the first coil spring paths has a profile similar to a cross-sectional profile of a respective coil spring taken in a plane parallel to a length of the respective coil spring. The resilient structure includes a second fiber batt strip joined with the first fiber batt strip. The second fiber batt strip has second coil springs disposed therein with second coil spring paths extending from respective second coil springs. Each of the second coil spring paths has a profile similar to a cross-sectional profile of a respective second coil spring taken in a plane parallel to a length of the respective second coil spring.

In one aspect of this invention, the first and second fiber batt strips are joined to have common top and bottom surfaces and the first and second coil springs have respective first and second top and bottom turns. The first and second top turns are substantially coplanar with the common top surface, and the first and second bottom turns are substantially coplanar with the common bottom surface.

In a further embodiment, the invention provides a resilient structure having a fiber batt with coil springs disposed therein and respective coil spring paths. Each of the coil spring paths extends from a respective coil spring and has a profile similar to a cross-sectional profile of the respective coil spring taken in a plane parallel to a length of the coil spring. A sheet material covers the upper ends of the coil springs; and in another embodiment, the sheet material covers the lower ends of the coil springs.

In yet another embodiment of the invention, an apparatus is provided for making a resilient structure that has a support surface to support a fiber batt strip. A fiber batt strip drive is used to move the fiber batt strip, and a gripper, disposed adjacent a side of the support surface, is able to releasably secure a coil spring therein with a length of the coil spring being substantially perpendicular to the support surface. A power supply is connectable to the gripper and is operable to heat the coil spring. A gripper drive is connected to the gripper and is operable to move the gripper over the support surface. In that motion, the gripper drive inserts the coil spring into the fiber batt while maintaining the length of the coil spring substantially perpendicular to the support surface to produce the resilient structure.

In a still further embodiment, the invention provides a method of forming a resilient structure by first providing a fiber batt and positioning a coil spring adjacent the surface. Next, the coil is heated and moved into the fiber batt to create a coil spring path in the fiber batt having a profile similar to a cross-sectional profile of the heated coil spring taken in a plane parallel to a longitudinal centerline of the coil spring.

In yet another embodiment, the invention provides a method of making a resilient structure by first supporting a fiber batt strip on a surface. Coil springs are then heated and inserted into the fiber batt strip while holding respective lengths of the first coil springs substantially perpendicular to the surface. The fiber batt strip is then cut to a desired length to provide a first fiber batt strip section having the first coil springs contained therein. Next, second coil springs are heated and inserted into the fiber batt strip while holding respective lengths of the second coil springs substantially perpendicular to the surface. The fiber batt is then cut a desired length to provide a second fiber batt strip section having the second coil springs contained therein. Thereafter, the first and second fiber batt strip sections are joined together to produce the resilient structure.

These and other advantageous features of the invention will be more readily understood in view of the following detailed description of various embodiments and the drawings.

DETAILED DESCRIPTION

Figure 1:
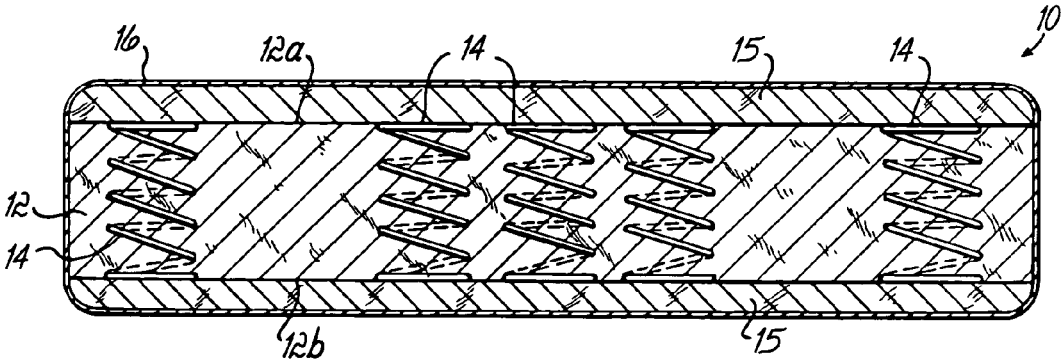
FIG. 1 is a cross sectional view of a resilient structure employing a fiber batt with interlocked coil springs held therein, in accordance with the principles of the invention.

Referring to FIG. 1, a resilient structure 10 includes a heat bonded, low melt, fiber batt 12. Such a fiber batt may be formed from a bale of dual polymer fibers, for example, Celbond® staple fibers, manufactured by Hoechst Celanese Corporation. The high melt or heat stable fibers are mixed with low melt fibers. Typically, a bale of the dual polymer fibers is picked and fluffed to a desired degree, then tumbled and fed to a feed hopper where it is blended with a desired mixture of heat stable fibers. Thereafter, the fiber mass is carded by a series of garneting machines and layered until a desired weight is achieved, as is known in the industry.

Densifying a fiber batt of this type involves various stages of heating and compressing to form a predetermined thickness. The dual polymer fiber includes a low melt polymer sheath which surrounds a thermally stable polyester core. When heated, compressed and allowed to cure, the external sheaths randomly adhere to surrounding fibers to densify and rigidify the resulting fiber batt. The density or rigidity of the fiber batt depends upon the duration and magnitude of compression, and the density may be varied to suit the use or application of the resulting resilient structure.

Referring to FIG. 1, the resilient structure 10 has a plurality of coil springs 14 disposed at selected locations and orientations in a fiber batt 12 and interlocked over their respective lengths with fiber strands immediately adjacent thereto. The fiber batt 12 has a three dimensional shape which is dictated by the particular size and shape of the resilient structure 10. Generally, the fiber batt 12 has a rectangular outer perimeter, with relatively flat top and bottom surfaces 12*a*, 12*b*, respectively, defining a relatively uniform thickness therebetween. The resilient structure 10 also has a plurality of relatively flat side surfaces that normally intersect the top and bottom surfaces.

The combination of the fiber batt 12 and coil springs 14 provides a resilient structure that can be used in many applications. Although the resilient structure of the batt 12 with the coil springs 14 can be provided for use without any covering, many applications require at least one layer of material 15 that covers the top and bottom turns of the coils. The layer of material 15 can be a fiber batt, a foam, a woven material, or a nonwoven material such as the "VERSARE" 27 nonwoven polypropylene commercially available from Hanes Industries of Conover, N.C.; a spring wire grid, or a wire woven material such as "PERM A LATOR" wire woven material commercially available from Flex-O-lators, Inc. of High Point, N.C., or other sheet material. The end use of the resilient structure often dictates the nature of the layer of material 15.

For example, if the resilient structure of the batt 12 with the coil springs 14 is to be used as a cushion, the layer of material 15 is comprised of one or more additional fiber batt-sandwiching layers that cover the ends of the springs 14. These layers may also be of heat bonded low melt fiber batt; and, along with the fiber batt 12, these layers may also be heated and then compressed during curing. A cushion application also often requires that one or more external covers 16, sometimes referred to as a "topper", protect the external surfaces of the resilient structure 10.

Figure 2:
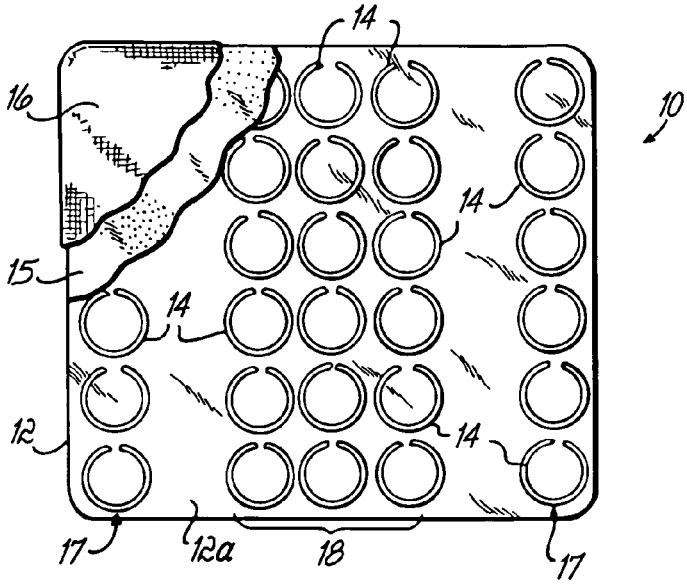
FIG. 2 is a diagrammatic top view of the resilient structure partially in cross-section.

FIG. 2 shows a cross sectional view through the fiber batt 12 and the springs 14. FIG. 2 shows that the arrangement of the coil springs 14 provides two relatively thin outer regions 17 of enhanced support and one relatively thick inner region of enhanced support 18 for the resilient structure 10. Other arrangements could also be used, depending upon the use of the resilient structure 10 and the desired areas for enhanced support.

Figure 3:
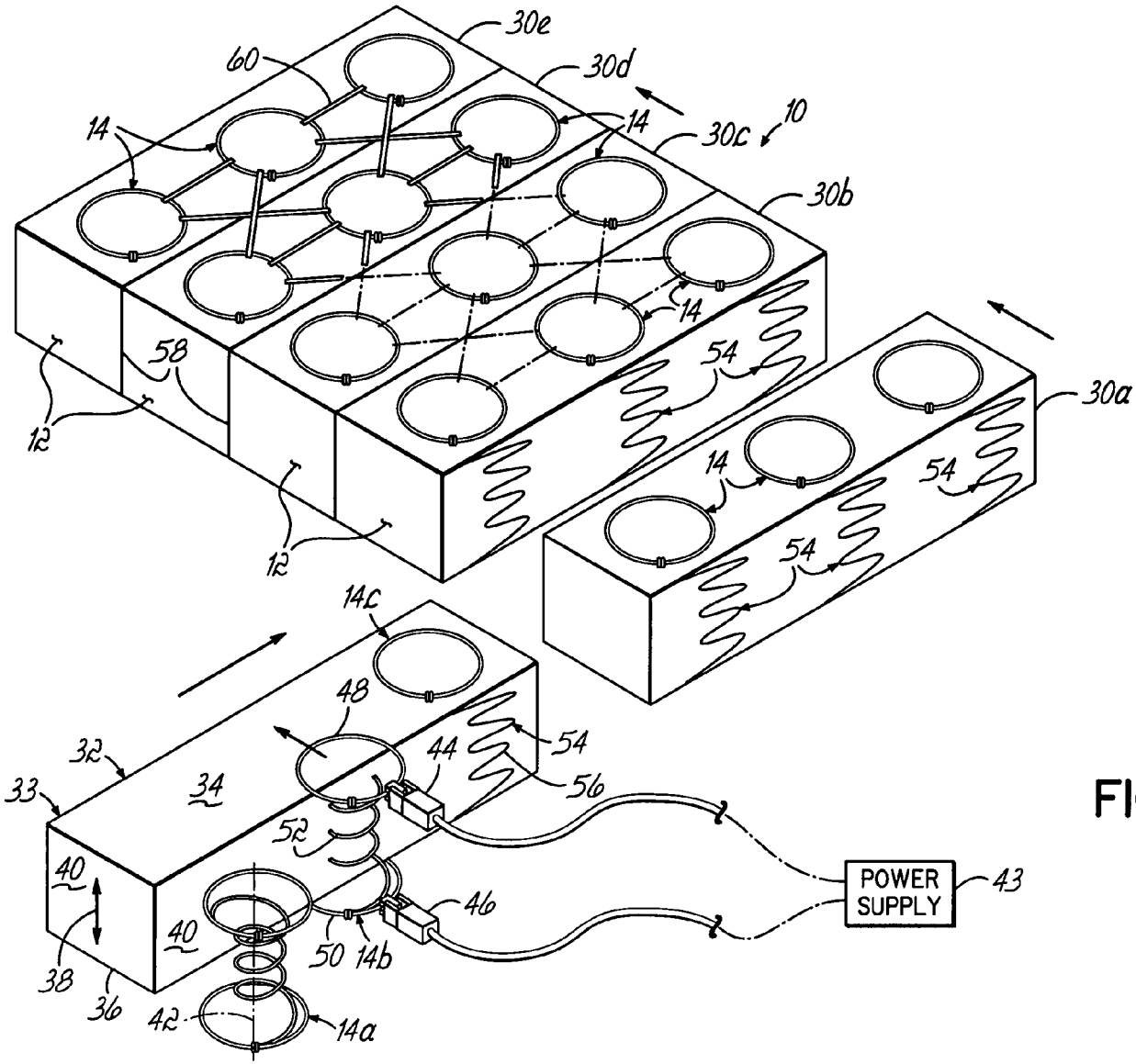
FIG. 3 is a diagrammatic illustration of a first method for inserting a coil spring into a fiber batt and the resulting resilient structure in accordance with the principles of the present invention.

Referring to FIG. 3, one embodiment of the resilient structure 10 is comprised of an assembly of resilient structure strips 30*a*–30*e* that are bonded or otherwise joined together to form an integral unitary fiber structure 10. In the example of FIG. 3, each of the resilient structure strips 30*a*–30*e* is identical in construction to the resilient structure strip 32. The resilient structure strip 32 is comprised of a fiber batt strip 33 that is generally rectangular in shape and has upper and lower surfaces 34, 36 separated by a thickness represented by the arrow 38. The fiber batt strip 33 has side surfaces 40 that are normally generally perpendicular to and intersect the top and bottom surfaces 34, 36.

To assemble the springs 14 inside the resilient structure 32, a coil spring 14*a* is disposed adjacent a side surface 40 such that a centerline 42 of the coil spring 14*a* extends generally perpendicular to and intersects the top and bottom surfaces 34,36. To readily insert the coil 14*a* into the fiber batt strip 33, the coil is heated to a temperature exceeding the melt temperature of the fiber strands of the fiber batt strip 33. One embodiment for heating the coil is to use a coil 14*b* as a resistance load on the output of a power supply 43. Electrodes 44, 46 electrically connected to outputs of the power supply 43 are clipped and electrically connected to respective top and bottom end turns 48, 50 of the coil 14*b*. As will be noted, the coil 14*b* is a knotted coil with variable diameter inner turns 52. Since there is no voltage drop across the end turns 48, 50, there is no current flow therethrough; and the turns 48, 50 are only heated by conduction of heat from the inner turns 52. The potential drop from the power supply 43 is applied across the inner turns 52, thereby heating those turns to a desired temperature.

The heated coil 14*b* is then capable of being pushed through the sidewall 40 of the fiber batt strip 33. The coil spring can be pushed using the structure on the electrodes 44, 46 or by other means. As the coil spring 14*b* moves through the fiber batt strip 33, the heated inner turns 52 melt fiber strands, thereby permitting the coil spring to be pushed into the fiber batt strip 33 to a desired location represented by the coil spring 14*c*.

In one embodiment, the inner turns 52 are heated to a temperature range of about 650–800° F. This elevated temperature not only permits the coil spring 14 to be readily inserted into the fiber batt strip 33, but it has the additional benefit of relieving mechanical stresses within the coil spring 14, thereby improving its mechanical memory and resiliency. Thus, with this embodiment, the heating of the coil 14*b* simultaneously stress relieves the coil springs 14 as well as permits their insertion into the fiber batt strip 33.

After the coil spring 14 reaches its desired location as represented by coil spring 14*c*, the coil spring cools and the fiber strands immediately adjacent the coil spring 14*c* solidify over a substantial portion of its length, thereby securely interlocking the coil spring 14 within the fiber strand structure of the fiber batt strip 33.

The insertion of the coil 14 into the fiber batt strip 33 leaves a coil spring path 54 extending between the coil spring 14*c* and the side surface 40. It should be noted that the coil spring path 54 is generally serpentine as it moves through the thickness 38 of the fiber batt strip 33. As such, the coil spring path 54 is made up of legs or segments 56 that are generally parallel to the top and bottom surfaces 34, 36. Thus, any disruption or breakage of the fiber strands through the thickness 38 occurs over a very short distance that is no greater than the thickness of the wire of the coil spring 14. By minimizing continuous strand breakage through the thickness 38 of the fiber batt strip 33, the change in resiliency and load carrying characteristics of the fiber batt 33 at the location of the coil spring 14*c* is also minimized. Thus, the process of inserting the coil spring 14 through a side 40 of the fiber batt strip 33 minimizes the amount of melt impact on the fiber batt strip 12.

The fiber batt manufacturing process normally orients the fiber strands in a common direction within the fiber batt strip 33. In many applications the fiber batt strips 33 are made such that the fiber strands are oriented in planes parallel to the surfaces 34, 36. In other words, the fiber strands are oriented in a direction perpendicular to the thickness 38 of the fiber batt strip 33, that is, in planes perpendicular to a direction in which a load is normally applied to the fiber batt strip 33. With that fiber strand orientation, the fiber batt strip 33 has the maximum and generally uniform resiliency and load carrying characteristics. Inserting the coil strip 14*b* in a direction parallel to the direction of orientation of the fiber strands results in the fiber strands interlayering with the inner turns 52 of the coil springs 14. Further, the resiliency and load carrying characteristics of the oriented fiber strands are enhanced by the resiliency of the coil spring 14. The interlayering of the fiber strands with the inner turns of the coil springs 14 enhances the support characteristics of the coil springs, ensures that the coil springs 14 cannot collapse upon themselves, helps to prevent noise, reduces compression loss and reduces fatigue of the coil springs 14 to increase the durability of the resilient structure strip 32.

In the embodiment of FIG. 3, the coil springs 14 have a length substantially equal to or slightly greater than the thickness 38 of the fiber batt strip 33. Thus, the upper and lower turns 48, 50 sit immediately on top of or are substantially parallel with their respective upper and lower surfaces 34, 36 of the fiber batt strip 33. With such a construction, it is not necessary to heat the upper and lower turns 48, 50. If the turns 48, 50 are heated, they tend to melt the fiber strands in the top and bottom surfaces 34, 36, thereby providing an uneven and inconsistent surface which may be undesirable depending on the application of the resilient structure 10.

After the coils 14 have been inserted into the fiber batt strips 33, the resilient structure strips 30*a*–30*e* are then joined or assembled to form a unitary integral resilient structure 10. The resilient structure strips 30*a*–30*e* can be joined to form joints 58 by gluing or other means. After the strips 30*a*–30*e* have been joined together, the coil springs 14 are often unitized by tying the upper and lower turns 48, 50 of the coil springs 14 together with connectors or a unitizing structure 60. Any known unitizing structure can be used, for example, strings, wire molded structures with clips, etc. The connectors 60 prevent the coil springs 14 from acting individually and force the coil springs 14 to work together to further enhance the resiliency and load carrying characteristics of the resilient structure 10. Often, the connectors 60 permit the coil density within a resilient structure 10 to be reduced.

As will be appreciated, the resilient structure 10 can be implemented in various alternative methods and structure. For example, the coil 14*b* is shown being heated by a resistance heating technique. Other heating processes may be used, for example, the coils 14 may be batch heated in an oven and then inserted into the fiber batt strips 33. Further, the temperature to which the coil springs 40 are heated can vary. In the previously described example, the coil springs are heated to a temperature in the range of about 650–800° F. in order to stress relieve the coil springs 14 during the insertion process. Stress relieving the coil springs 14 improves the coil spring memory and resiliency. As will be appreciated, in other applications, the stress relieving process of the coil may occur prior to the insertion process; and in that application, the coil springs 14 need only be heated to a temperature sufficient to melt the fiber strands within the fiber batt strip 33. The temperature to which the coil springs are heated depends on the wire gage of the coil springs 14, the number of turns, the density of the fiber strands, the desired rate of coil insertion, etc.

The insertion process described with respect to FIG. 3 provides a high quality resilient structure 10 independent of the type of coil springs 14 utilized. For example, the coil springs 14 may have constant diameter or variable diameter turns over their length. Further, the top and bottom turns may be knotted or unknotted.

In the application described with respect to FIG. 3, the fiber batt strip 33 normally has fiber orientations generally parallel to the top and bottom surfaces 34, 36. While it is believed that such a fiber orientation provides the highest quality resilient structure 10, in some applications the fiber batt strip 33 will have fiber strands oriented generally perpendicular to the top and bottom surfaces 34, 36 and generally extending in planes perpendicular to the top and bottom surfaces 34, 36 and parallel to the thickness 38. Alternatively, as will be appreciated, the fiber batt strip 33 can be cut such that the fiber strands are oriented in directions oblique to, or angled with respect to, the thickness 38. Regardless of the orientation of the fiber strands within the fiber batt strip 12, inserting the coils 14 through a side surface 40 is believed to provide the highest quality and most consistent resilient structure 10. However, the present invention has a further alternative embodiment in which the heated coil springs are inserted through one of the surfaces 34, 36 and through the thickness of the fiber batt strip 33.

Although the embodiment of FIG. 3 is illustrates a common arrangement of coils 14 within the fiber batt strips 33, as will be appreciated, each fiber batt strip 33 may have a separate arrangement of coil springs 14. For example, one strip may have three coils arranged therein and an adjacent strip have only two spaced substantially between the three coils of the adjoining strip.

Figure 4A:
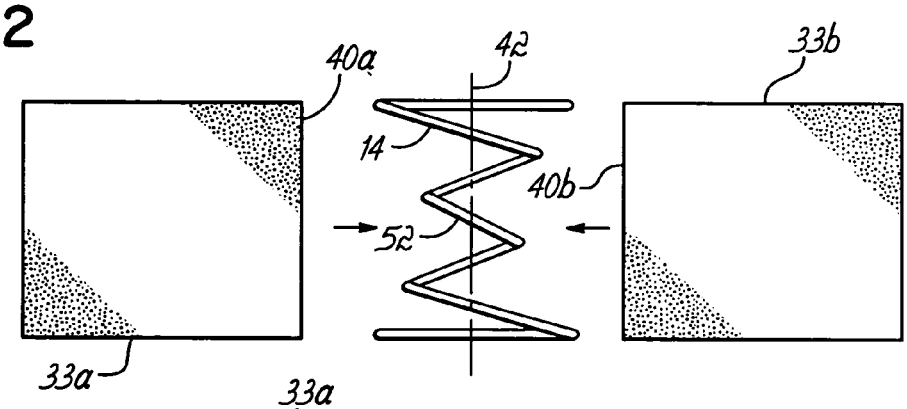
FIGS. 4A and 4B are diagrammatic illustrations of another method for inserting a coil spring into a fiber batt and the resulting resilient structure in accordance with the principles of the present invention.
Figure 4B:
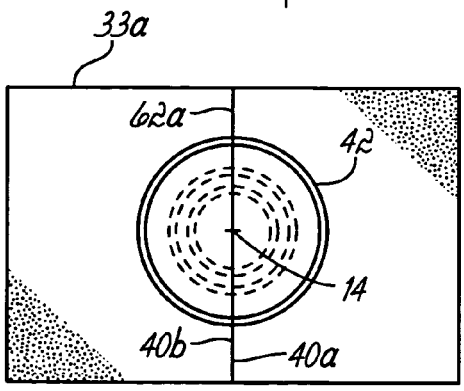

As a further alternative embodiment, referring to FIG. 4, a coil spring 14 is partially inserted into a side surface 40*a* of a first fiber batt strip 33*a*, for example, to a point where the centerline 42 is proximate the surface 40*a*. Thereafter, as shown in FIG. 4A, a side surface 40*b* of another fiber batt strip 33*b* is placed against the surface 40*a* of strip 33*a* such that the coil spring 14 straddles a joint 62*a*. With such an assembly, the coil spring 14 can be heated or not heated. If the coil spring 14 is heated, fiber strands penetrate between, and are interlayered with, the inner turns 52 of the coil spring 14. If the coil spring 14 is unheated, the inner turns 52 tend to push and hold the fiber strands from penetrating between the turns 52, thereby creating a void of fiber strands on the interior of the coil spring 14. Such a void of fiber strands does not make optimum use of the assembly and provides a resilient structure 10 having slightly less desirable resiliency and load carrying characteristics.

Figure 5:
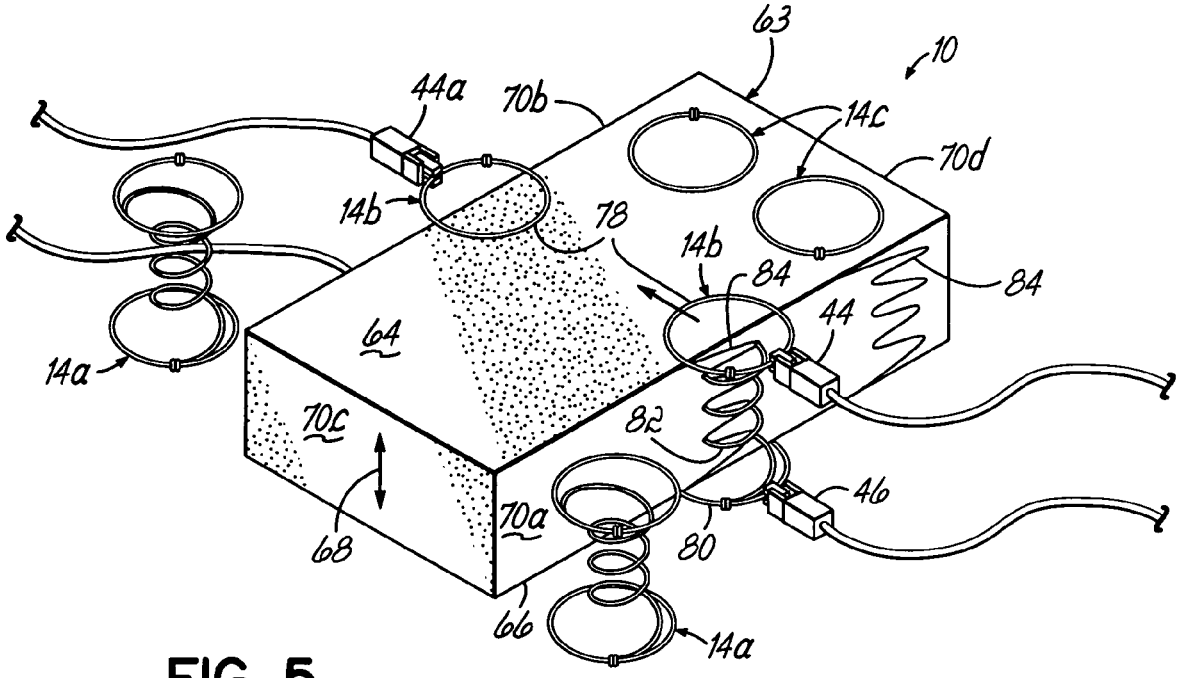
FIG. 5 is a diagrammatic illustration of a further method for inserting a coil spring into a fiber batt and the resulting resilient structure in accordance with the principles of the present invention.

In a still further embodiment, referring to FIG. 5, a fiber batt strip 63 is substantially identical in construction to the fiber batt strip 33 previously discussed. However, FIG. 5 illustrates an alternative process for inserting the springs 14 into the fiber batt strip 63. The fiber batt strip 63 has upper and lower surfaces 64, 66 separated by a thickness indicated by the arrow 68. Side surfaces 70*a*–70*d* are normally perpendicular to and intersect the top and bottom surfaces 64, 66. In the embodiment of FIG. 5, the coil springs 14 are disposed adjacent the side surfaces 70*a*, 70*b*. Heating electrodes 44, 46 are applied to the upper and lower turns 78, 80 to heat the inner turns 82. The coil springs 14*b* are then capable of being pushed through the sides 70*a*, 70*b* of the fiber batt strip 63 to their desired location as shown by coil springs 14*c*. When in the desired location, the coil springs 14*c* will have created a coil spring path 84 extending between the coil springs 14*c* and the side walls 70*a*, 70*b*.

As will be appreciated, in other embodiments, the coil springs 14 may be inserted through the opposite side walls 70*a*, 70*b* either one at a time or simultaneously. Thus, in the example of FIG. 5, two separate sets of coil springs 14 can be simultaneously inserted into different side walls of the fiber batt strip 63. Thus, all six coil springs 14 can be simultaneously heated and inserted into the fiber batt strip 63. As will further be appreciated, although the coil springs 14 are described as being inserted through the side walls 70*a*, 70*b*, they may be similarly inserted through the side walls 70*c*, 70*d*.

Figure 6:
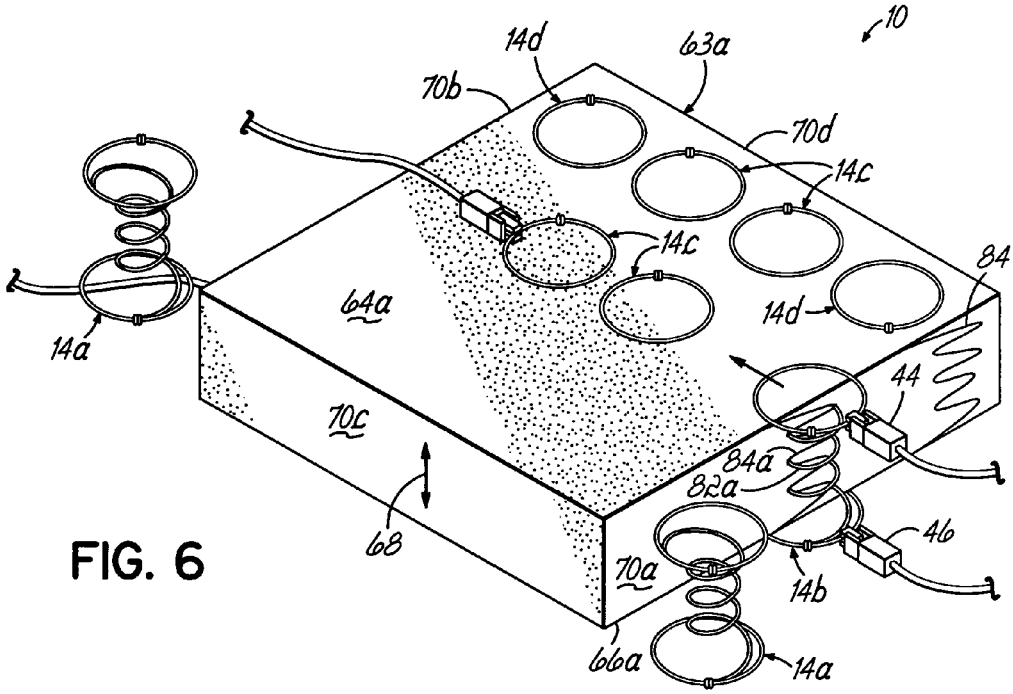
FIG. 6 is a diagrammatic illustration of a still further method for inserting a coil spring into a fiber batt and the resulting resilient structure in accordance with the principles of the present invention.

Referring to FIG. 6, another embodiment is shown for inserting coil springs 14 into a fiber batt strip 63*a* comprised of upper and lower surfaces 64*a*, 66*a*, respectively, that are separated by a thickness indicated by the arrow 68*a*. Side surfaces 70*a*–70*d* are normally perpendicular to and intersect the top and bottom surfaces 64*a*, 66*a*. In a manner similar to that previously described, the coil springs 14*a* are disposed adjacent side surfaces 70*a*, 70*b*; and resistance heating is used to heat the inner turns 82*a* to a temperature permitting the coil to melt fiber strands within the fiber batt strip 63*a*. The coils 14*b* are then inserted through the fiber batt strip 63*a* to their desired location as represented by coil springs 14*c*. In that process, the coils 14*b* create a coil spring path 84*a* extending between the coils 14*c* and a respective side surface 70*a*, 70*b* through which the coil was inserted. In the embodiment of FIG. 6, a second coil 14*b* is heated and inserted substantially along the same coil spring path 84*a* that was created by the insertion of coil springs 14*c*. Thus, utilizing the same coil spring path 84*a*, a second coil can be inserted to its desired location represented by coil spring 14*d* with only minimal breakage and disruption of the oriented fiber strands within the fiber batt strip 63*a*.

As will be appreciated, the embodiment illustrated in FIG. 6 is subject to the same alternative embodiments and methods described with respect to FIGS. 3–5. For example, the coil springs 14 may be inserted one at a time or in parallel. Further, the coil springs may be inserted across surfaces 70*a*, 70*b* as described or alternatively across surfaces 70*c* and 70*d*. Alternatively, the coil springs 14 may be inserted one at a time or simultaneously into any combination of the side surfaces 70*a*–70*d*.

Figure 7:
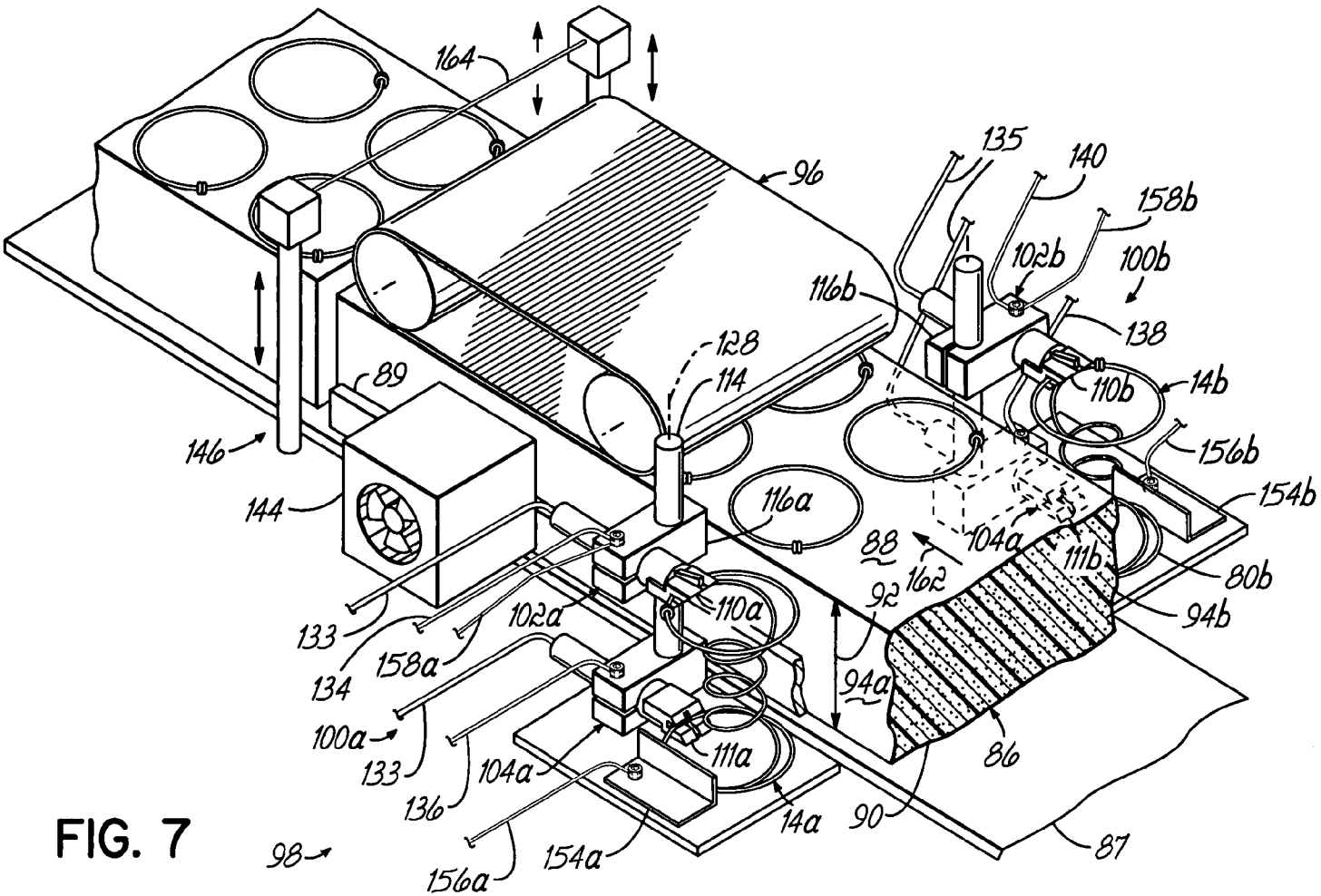
FIG. 7 is a diagrammatic perspective view of a production line including insertion devices for inserting coil springs through side walls of a fiber batt to form a resilient structure in accordance with the principles of the present invention.

Yet another embodiment for inserting coil springs into a fiber batt strip is illustrated in FIGS. 7–11. Referring to FIG. 7, a fiber batt strip 86 is supported on a low friction surface 87. Side rails 89 are mounted on both sides of the fiber batt strip 86 to restrict its lateral motion. As will be appreciated, to simplify the drawing and better show more important components, only a portion of the side rails 89 is shown. The fiber batt strip has upper and lower surfaces 88, 90, respectively, that are separated by a thickness indicated by the arrow 92. Lateral side surfaces 94*a*, 94*b* are normally perpendicular to and intersect the top and bottom surfaces 88, 90. A drive belt 96 is mounted above the fiber batt strip 86 and is operative to move the fiber batt strip 86 past a insertion station 98. The coil spring insertion station 98 includes respective left and right coil spring insertion devices 100*a*, 100*b* mounted on each side of the support surface 87. The left coil spring insertion device 100*a* is made from similar parts as the right coil spring insertion device 100*b*; however, the parts are assembled such that the right coil spring insertion device 100*b* is a mirror image of the left coil spring insertion device 100*a*. Consequently, a detailed description of the coil spring insertion device 100*a* will serve equally as a description for the coil spring insertion device 100*b*.

Figure 8:
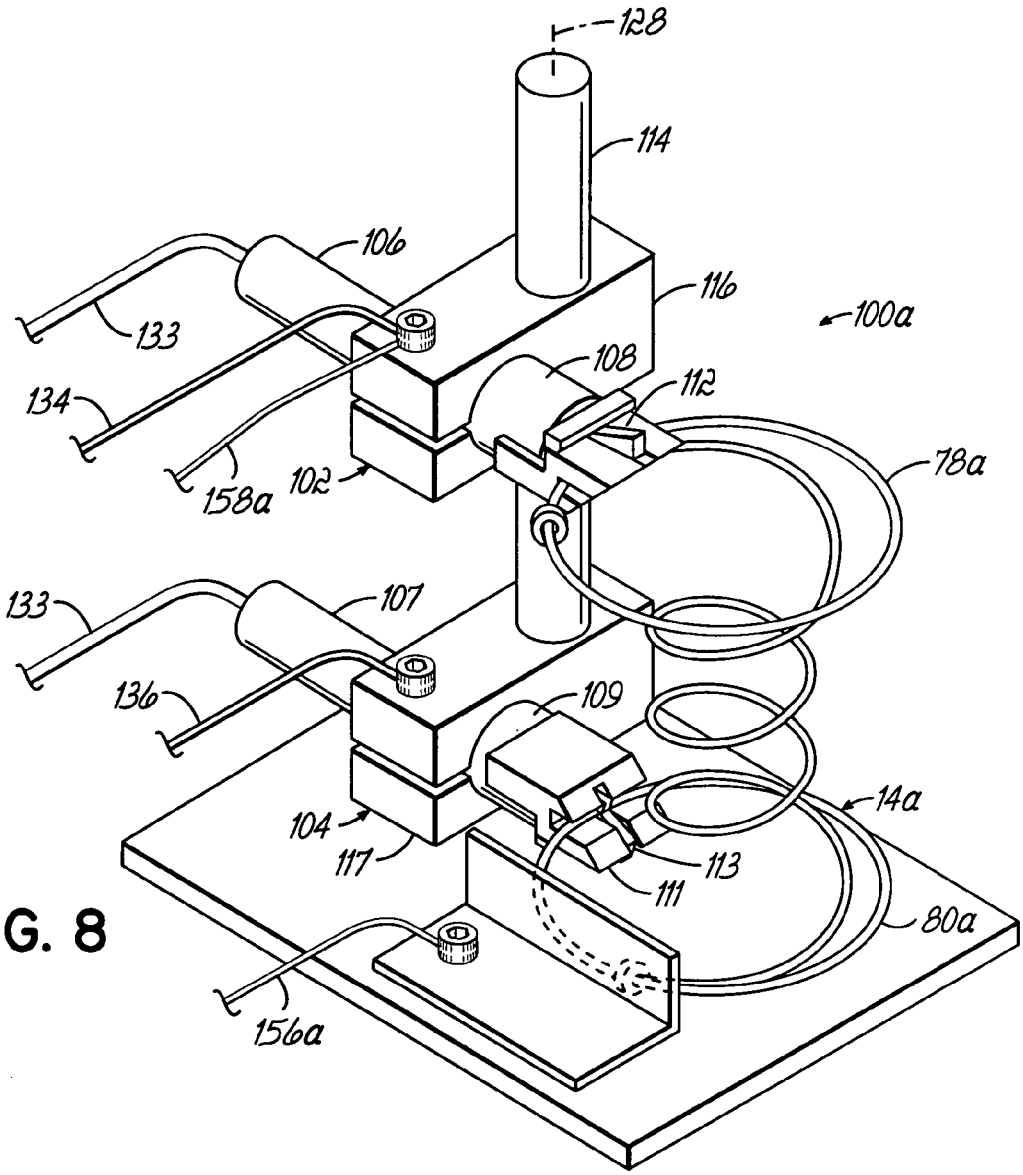
FIG. 8 is a diagrammatic perspective view of one of the insertion devices shown in FIG. 7.
Figure 8A:
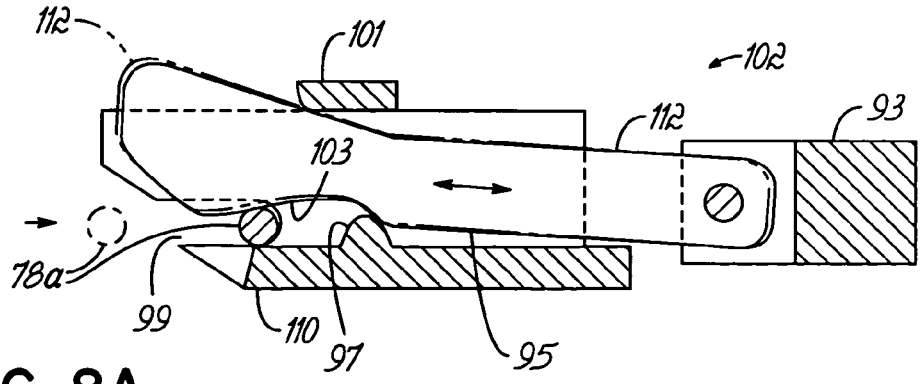
FIG. 8A is a centerline cross-sectional view of a gripper of FIG. 8, which illustrates the structure of the gripper jaws.

Referring to FIG. 8, the left coil spring insertion device 100*a* has upper and lower grippers 102, 104, respectively. The upper gripper 102 includes an upper gripper actuator 106, for example, an air cylinder, mounted to an inner or proximal end of an upper gripper arm 108. A fixed or stationary upper gripper jaw 110 is mounted to the outer or distal end of the upper gripper arm 108. Referring to FIG. 8A a movable jaw 112 is pivotally connected to an outer or distal end of an upper gripper actuating rod 93, for example, a cylinder rod, within the upper actuator 106. To open the upper gripper 102, the cylinder is operated to extend the cylinder rod 93 and movable jaw 112. In doing so, a lower edge 95 of the movable jaw 112 is elevated by its contact with a lift button or cam 97. That lifting action raises the movable jaw 112 out of the mouth 99 of the fixed jaw 110 to a position shown in phantom in FIG. 8A. An end turn, for example, a top turn 78*a*, of a coil can be inserted into the mouth 99 of the fixed jaw 110.

To close the upper gripper 102, the cylinder 106 is operated to retract the cylinder rod 93 and movable jaw 112. The upper motion of the movable jaw 112 is limited by a pressure plate 101, and a clamping edge 103 of the movable jaw 112 secures the top turn 78*a* in the mouth 99 of the fixed jaw 110. Thus, operating the upper actuator 106 moves the movable jaw 112 with respect to the fixed jaw 110 to selectively secure and release an upper end turn 78*a* of the coil spring 14*a*. The grippers 102, 104 are substantially identical; and therefore, the lower gripper 104 has a lower gripper actuator 107 on one end of a lower gripper arm 109. A lower fixed jaw 111 is mounted on the other end of the lower gripper arm 109, and a lower movable jaw 113 is operable by the lower gripper actuator 107 to selectively secure and release a lower end turn 80*a* of the coil spring 14*a*.

Figure 9:
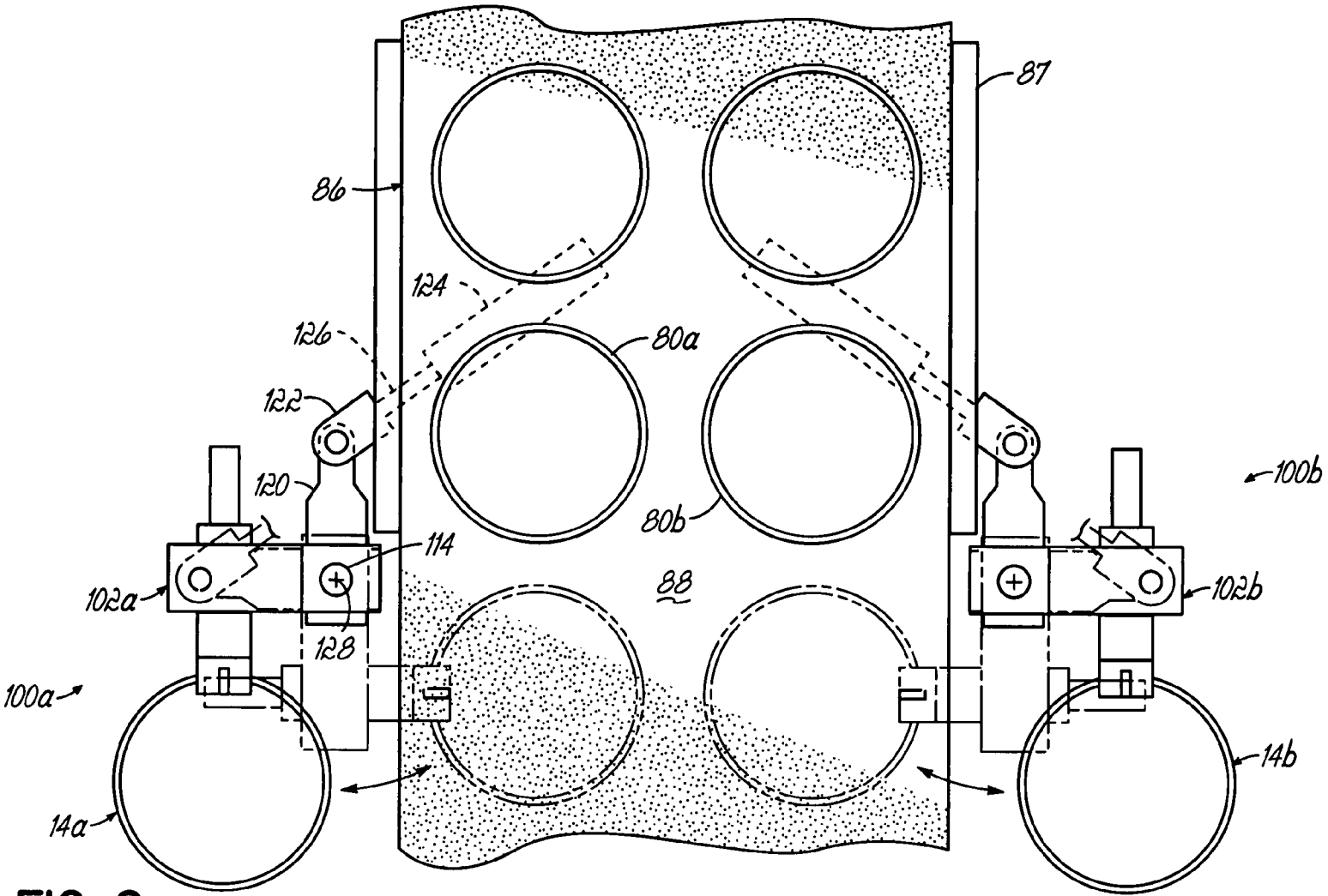
FIG. 9 is a top plan view of the insertion devices of FIG. 7.

The respective upper and lower grippers 102, 104 are mounted to a rotatable column or shaft 114 by respective upper and lower mounting blocks 116, 118. Referring to FIG. 9 and the coil insertion device 100*a*, a lower end of the rotator shaft 114 is rigidly connected to one end of a rotator arm 120. An opposite end of the rotator arm 120 is pivotally connected to a clevis 122. An actuator 124, for example, an air cylinder, has a movable element 126, for example, a cylinder rod, an outer or distal end of which is rigidly connected to the clevis 122. Thus, when the actuator 124 is operated to extend the cylinder rod 126, the rotator arm 120 rotates the shaft 124 and upper and lower grippers 102, 104 about an axis of rotation 128 and in a direction toward the fiber batt strip 86. The upper and lower grippers 102, 104 with the coil 14*a* rotate through an arcuate or angular path of approximately 90° to a position illustrated in phantom in FIG. 9. Reversing the operation of the actuator 124 retracts the cylinder rod 126 and rotates the upper and lower grippers 102, 104 in an opposite direction away from the fiber batt strip 86 and back to their starting positions illustrated in solid in FIG. 9. The coil insertion device 100*b* has similar components that operate in a similar way to effect a rotation of the coil insertion device 100*b* toward and away from the fiber batt strip 86.

Figure 10:
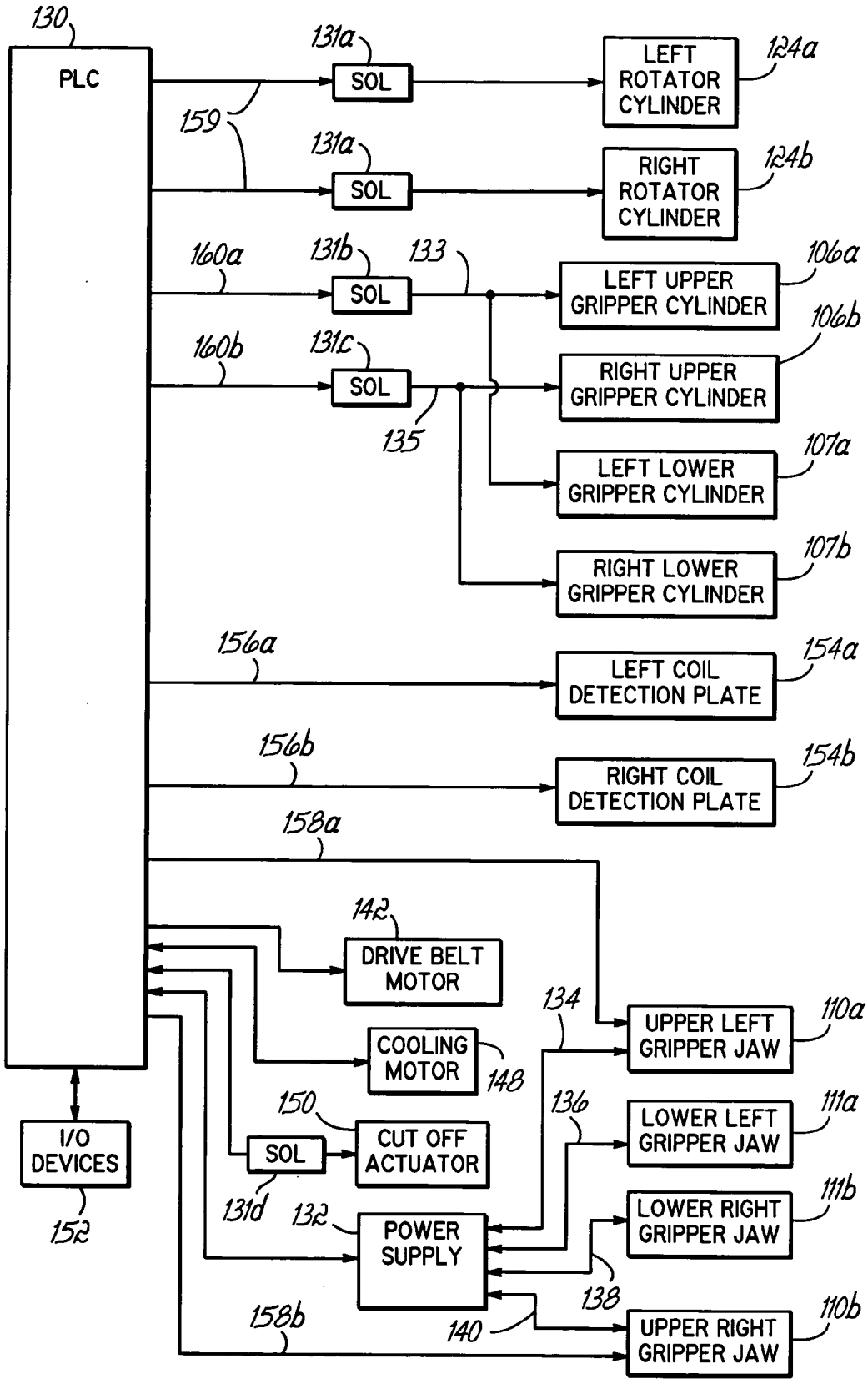
FIG. 10 is a schematic circuit diagram of a control and various actuators that are used to control the operation of the insertion devices of FIG. 7.

Referring to FIG. 10, a programmable logic controller ("PLC") 130 is used to control the operation of the various pneumatic cylinders. Thus, the PLC 130 has outputs connected to coils in solenoids 131. The solenoids 131 are connected to a source of pressurized air (not shown) and provide a pressurized air flow to the various cylinders in a known manner. Thus, the PLC 130 provides signals on outputs 159 that are operative to switch the states of the solenoids 131 a in a known manner to control the operation of the left and right rotator cylinders 124*a*, 124*b*. The PLC 130 also provides signals on outputs 160*a*, 160*b* that are operative to switch the states of the solenoids 131*b*, 131*c* in a known manner to control the operation of the left upper and lower gripper cylinders 106*a*, 107*a* and the right upper and lower gripper cylinders 106*b*, 107*b*. The PLC 130 has further outputs 156, 158 connected to left and right coil detection plates 154*a*, 154*b* and the left and right lower gripper jaws 107*a*, 107*b*. The PLC 130 is further electrically connected to, and commands the operation of, a power supply 132 having outputs 134–140 electrically connected to the left and right upper fixed gripper jaws 110*a*, 110*b* and the left and right lower fixed gripper jaws 111*a*, 111*b*.

The PLC 130 is further electrically connected to a drive motor 142 that is mechanically connected to, and operates, the drive belt 96. As shown in FIG. 7, a cooling station 144 and cutoff station 146 are located adjacent the support surface 87 downstream of the coil spring insertion station 98. The PLC 130 is operatively connected to a cooling motor 148 that is turned on and off by the PLC 130 to provide cooling air on the fiber batt strip 86 moving past the cooling station 144. The PLC 130 is also operatively connected to a solenoid 131*d* that provides pressurized air to a cutoff actuator 150, for example, a cylinder, which is located at the cutoff station 146.

The PLC 130 has a user input/output ("I/O") interface 152 that provides various user operable input devices, for example, pushbuttons, switches, etc., as well as various sensory perceptible output devices, for example, lights, a visual display such as an LCD screen, etc. The user I/O 152 permits the user, in a known manner, to store programmable instructions in the PLC 130 such that it is operable to provide various output signals to the cylinders and motors, thereby executing an automatic cycle of operation. Such an automatic cycle of operation is represented by the flowchart illustrated in FIG. 11. The user I/O 152 further permits the user to command the operation of individual cylinders, motors and the power supply that are connected to the outputs of the PLC 130.

In use, a fiber batt strip 86 is first placed on the surface 87. The coil spring insertion devices 100*a*, 100*b* have several adjustments that allow them to be matched with a variety of fiber batt strips 86. For example, referring to FIG. 8, the upper and lower gripper arms 108, 109 are adjustable with respect to respective upper and lower mounting blocks 116, 117. That is, the length of the gripper arms 108, 109 extending from the respective mounting blocks 116, 117 can be adjusted in order to adjust the spacing of the coils from side-to-side across the batt. Further, the gripper arms 108, 109 can be rotated relative to the respective mounting blocks 116, 117 in order to adjust the parallelism of the fixed gripper jaws 110, 111. In addition, the height of the upper mounting block 116 relative to the rotary shaft 114 can be adjusted to accommodate different thicknesses of the fiber batt strip 86.

Figure 11:
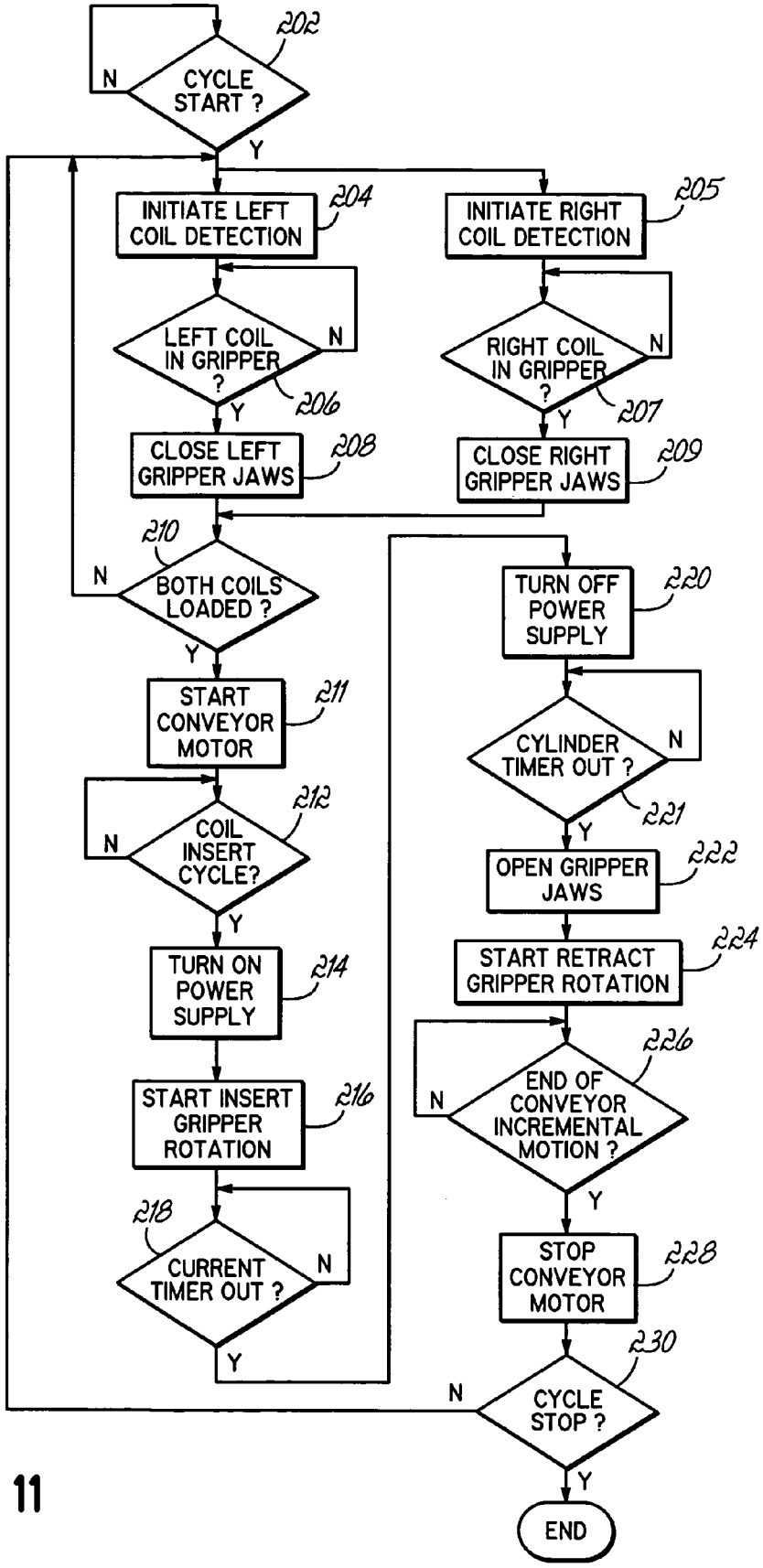
FIG. 11 is a flowchart illustrating a process executable by the control of FIG. 10 for controlling the operation of the insertion devices of FIG. 7 to automatically insert coil springs into the fiber batt.

After all of the setup adjustments have been made, the PLC 130 is then used to control the operation of the coil insertion station shown in FIG. 7. Referring to FIG. 11, at 202, the PLC 130 first awaits the initiation of a cycle start command that is provided by either, a user actuating one of the I/O devices 152 or, another control (not shown). Upon receiving such a command, the PLC 130 provides, at 204, a signal, for example, a low voltage, over outputs 156*a*, 156*b* to the left and right coil detection plates 154*a*, 154*b* (FIG. 7). The the left and right upper fixed gripper jaws 110*a*, 110*b* are connected via mounting blocks 116*a*, 116*b* and outputs 158*a*, 158*b* to a ground. Thus, a voltage potential exists between the left and right coil detection plates 154*a*, 154*b* and respective left and right upper fixed gripper jaws 110*a*, 110*b*. Thereafter, coil springs 14*a*, 14*b* are loaded into respective left and right coil insertion devices 100*a*, 100*b*. The coil spring loading operation can be accomplished either manually or automatically. As a coil 14*a* is pushed toward the left coil insertion device 100*a*, its lower end turn 80*a* contacts the coil detection plate 154*a*; and continued motion of the coil 14*a* toward the left coil insertion device 100*a* causes the upper end turn 78*a* to contact the left upper stationary jaw 110*a*. Simultaneous contact of the lower end turn 80*a* with the left coil detection plate 154*a* and the upper end turn 78*a* with the left upper fixed jaw 110*a* results in a current flow that is detected, at 206, by the PLC 130. That current flow indicates that the coil 14*a* is loaded in the left gripper 100*a*. As will be appreciated, other electrical connections can be made to detect continuity between the detection plates 154*a*, 154*b* and the respective left and right upper fixed jaws 110*a*, 110*b*.

Upon detecting, at 206, that the coil 14*a* is loaded in the gripper 110*a*, the PLC 130 then provides output signals, at 208, on an output 160 to solenoid 131*b*, which cause the solenoid to supply pressurized air on lines 133 to operate the left upper and lower gripper cylinders 106, 107 (FIG. 8). Operating the cylinders 106, 107 causes the respective movable gripper jaws 112, 113 to close and clamp the respective top and bottom turns 78*a*, 80*a* of the coil 14*a* against the respective fixed gripper jaws 110, 111. Thus, the left upper and lower grippers 102*a*, 104*a* close and secure the respective top and bottom turns 78*a*, 80*a* of the coil spring 14*a* therein. As shown at 205 and 207 of FIG. 11, a coil spring 14*b* is similarly detected as being loaded in the right coil insertion device 100*b*. And at 209, the PLC 130 provides a signal on output 160*b* to solenoid 131*c*, which supplies pressurized air on lines 135 to the right upper and lower grippers 106*b*, 107*b*, thereby securing the coil 14*b* in the right coil insertion device 100*b*. The PLC 130 detects, at 210, that the coil springs 14*a*, 14*b* are loaded in both of the left and right coil insertion devices 100*a*, 100*b*. Thereafter, the PLC 130 provides an output signal, at 210, to the drive belt motor 142, thereby initiating operation of the drive belt 96 (FIG. 7) and moving the fiber batt strip 86 in the direction indicated by a motion direction arrow 162.

As will be appreciated, the distance separating the coil springs 14 in the fiber batt strip 86 is variable and may be programmed into the PLC 130 by the user. Further, there are at least two options for performing a coil insertion process. A first option is to move the fiber batt strip 86 an incremental distance representing a desired separation between the coil springs, stopping the drive belt 96, and then inserting the coil springs 14 through the sidewalls 94 and into the fiber batt strip 86. In this embodiment, the coil springs are rotated through a 90° arc in the process of inserting them into the fiber batt strip 86. As will be appreciated, such insertion motion produces a force vector in the same direction as the motion direction arrow 162. Further, such force vector may be sufficient to move the fiber batt strip 86 through a small displacement in that direction. Further, in that process, the fiber batt strip 86 may experience a small displacement relative to the drive belt 96; and any such relative motion will reduce the accuracy of the placement of the coil springs 14 in the fiber batt strip 86.

In a second coil spring insertion process, the coil springs 14 are inserted while the fiber batt strip 86 is being moved by the drive belt 96. With the fiber batt strip 86 moving, the coil spring insertion forces are not sufficient to change the relative position of the fiber batt strip 86 with respect to the drive belt 96. Assuming this second process is being used, after the coils 14*a*, 14*b* are loaded in the coil insertion devices 100*a*, 100*b*, the PLC 130 provides, at 211, an output signal to initiate operation of the drive belt motor 142, thereby initiating motion of the fiber batt strip over the surface 87 and past the coil insertion devices 100*a*, 100*b*.

The PLC 130 also tracks the displacement of the fiber batt strip 86, and for a given separation between the coil springs, the PLC 130 then is able to determine, at 212, the appropriate time to initiate a coil spring insertion cycle. The displacement of the fiber batt strip 86 can be determined directly with known means by either, detecting motion of the fiber batt strip 86 with a position feedback device or, detecting motion of the drive belt by measuring a shaft rotation in the drive belt motor 142 or another component in its drive train. Alternatively, the displacement of the fiber batt strip 86 can be determined by using an internal timer within the PLC 130. The displacement can be calculated by the PLC 130 knowing the velocity of the drive belt 96 and the elapsed time that the drive belt has been operating. The above quantifying of fiber batt strip displacement can be used to control the initiation of a coil spring insertion cycle so that a desired coil spring separation is achieved. Alternately, the optimum time to initiate a coil spring insertion cycle after initiating an operation of the drive belt motor 142 can be determined experimentally in a pre-production process and then programmed into the PLC 130. Thus, using one of the above or some other method, the PLC 130 detects, at 212, when a coil insertion cycle is to be initiated.

Immediately thereafter, the PLC 130 provides a signal, at 214, to turn on the power supply 132 (FIG. 10) and provide a coil spring heating current on the outputs 134–140. That heating current is of a sufficient magnitude to raise the temperature of the coil springs 14*a*, 14*b* to either, a desired stress relieving temperature or, a temperature greater than the melt temperature of the fiber batt strip 86. The melt temperature of the fiber batt strip 86 is normally less than the stress relieving temperature. The time required to heat a coil spring to a desired temperature is dependent on many variables, and in some applications, that time can only be precisely determined by performing a coil insertion process in a pre-production mode. In such a mode, the system can be tuned to determine an optimum length of a coil heating cycle; and thereafter, that time period can be programmed into the PLC 130. Therefore, simultaneously with initiating operation of the power supply 132, the PLC 130 starts an internal heating cycle timer that controls the length of the coil heating cycle.

Further, substantially simultaneously with initiating the coil heating cycle at 214, the PLC 130 initiates, at 216, a rotation of the coil insertion devices 100*a*, 100*b*. That is accomplished by the PLC 130 providing output signals to the solenoids 131*a* that cause the cylinders 124*a*, 124*b* to extend their respective cylinder rods and initiate a simultaneous rotation of the left and right upper and lower grippers 102*a*, 102*b*, 104*a*, 104*b*. Simultaneously, the PLC 130 starts an internal cylinder timer that is set to a time that exceeds the time required by the gripper cylinders 102*a*, 102*b*, 104*a*, 104*b*, to fully extend their respective cylinder rods. Those rotations cause the heated coil springs 14*a*, 14*b* to be inserted into the respective sidewalls 94*a*, 94*b* of the fiber batt strip 86. The insertion of the coils 14*a*, 14*b* occurs simultaneously with the motion of the fiber batt strip 86 on the drive belt.

Thereafter, at 218, the PLC detects the state of the internal timer measuring the length of the coil heating cycle. In most applications, the coil heating cycle will end prior to, or immediately after, the coils springs 14*a*, 14*b* contact the respective sidewalls 94*a*, 94*b* in the coil insertion cycle. Upon detecting the internal heating cycle timer timing out, the PLC 130 provides, at 220, an output signal causing the power supply 132 to turn off, thereby terminating current flow on the outputs 134–140 to the left and right upper fixed gripper jaws 110*a*, 110*b* and the left and right lower fixed gripper jaws 111*a*, 111*b*.

The rotations of the left and right coil insertion devices 100*a*, 100*b* continue until the left and right rotation cylinders 124*a*, 124*b* reach the end of their strokes. When the PLC 130 detects, at 221, that the cylinder timer has timed out or expired, the PLC 130 then provides, at 222, signals on outputs 160*a*, 160*b* to respective solenoids 131*b*, 131*c*. The solenoids 131*b*, 131*c* provide pressurized air on respective lines 133, 135 that cause respective cylinders 106*a*, 106*b*, 107*a*, 107*b* to change state. Thus, the left and right upper and lower grippers 102*a*, 102*b*, 104*a*, 104*b* are simultaneously commanded to open and release the respective end turns 78*a*, 78*b*, 80*a*, 80*b* of the coils 14*a*, 14*b*. Thereafter, the PLC 130 provides, at 224, output signals to the solenoids 131*a* that cause the left and right rotation cylinders 124*a*, 124*b* to retract the left and right coil insertion devices 100*a*, 100*b* from the fiber batt strip 86. Reversing the operation of the left and right rotation cylinders 124*a*, 124*b* causes their respective cylinder rods to retract, thereby moving the left and right upper and lower grippers 102*a*, 102*b*, 104*a*, 104*b* in an opposite direction. Thus, the left and right upper and lower grippers 102*a*, 102*b*, 104*a*, 104*b* are moved back to their starting positions where their respective gripper arms are substantially parallel to a side of the fiber batt strip.

The PLC 130 then proceeds to determine whether, at 226, the drive belt 96 has moved the fiber batt strip 86 through a desired increment of motion required to achieve the desired coil spring spacing. If so, the PLC 130 then, at 228, provides an output signal to stop the operation of the drive belt motor 142. Thereafter, the PLC 130 detects, at 230, whether a cycle stop condition exists; and if not, the PLC 130 again, at 204, 205, provides a coil detection signal on outputs 156, 158 to detect when coils 14 are again loaded in the left and right coil insertion devices 100*a*, 100*b*. Thereafter, the coil insertion process of FIG. 11 is repeated until a cycle stop signal is detected.

Referring back to FIG. 7, after coils 14 have been inserted, they are moved with the fiber batt strip 86 by the drive belt past a cooling station 144. The cooling station has a cooling motor 148 (FIG. 10) that is operated by the PLC 130. As will be appreciated, one or more cooling stations can be provided at the point of coil insertion or downstream to provide sufficient cooling of the hot coils 14 with the fiber batt strip 86, so that potential coil drift is minimized as the grippers are retracted from the fiber batt strip 86.

Downstream of the cooling station is a cutoff station 146. As shown in FIG. 3, a cushion can be made by gluing together fiber batt strips containing the coil springs. The size of the cushion is controlled by an increment of motion detected by the PLC at 226 of FIG. 11; and therefore, after the PLC 130 stops the drive motor 142 (FIG. 10), the PLC will often initiate operation of the cutoff actuator 150, thereby cutting the fiber batt strip with the coil springs therein to a desired length. Referring to FIG. 7, the cutoff actuator is operative to move a heated wire 164 down through the fiber batt strip and then back up to its starting position. As will be appreciated, although a hot wire cutter is illustrated and discussed, in alternative embodiments, a knife or other cutoff device may be used.

The above-described apparatus for automatically inserting coils in a fiber batt strip 86 has great versatility. For example, as shown in FIG. 3, a resilient structure can be made by joining strips of fiber batt with coil springs disposed therein. In FIG. 3, the fiber batt strips have only a single row of coil springs in each strip; however, using the apparatus of FIG. 7-10, fiber batt strips are produced with a double row of coil springs in each strip. The versatility of the apparatus of FIG. 7-10 can be further demonstrated by referring to FIG. 2. The apparatus of FIG. 7-10 can be used to make the resilient structure of FIG. 2 by joining fiber batt strips, wherein each fiber batt strip is comprised of two horizontal rows of coil springs. The PLC 130 can be programmed such that a coil spring location is skipped. Thus, in the pattern of seven coil spring locations in any two horizontal rows, the PLC 130 can be programmed to provide an incremental motion of the fiber batt strip that results in the second and sixth coil spring locations being skipped.

In another application, the apparatus of FIG. 7-10 can be used to make the resilient structure of FIG. 2 by joining fiber batt strips, wherein each fiber batt strip is comprised of two vertical rows of coil springs. Again, the PLC 130 can be programmed to insert coil springs on only either the left or the right side of the fiber batt strip. Further, as described earlier, the PLC 130 can be programmed to insert coil springs on both of the left and right sides of the fiber batt strip. Thus, resilient structures for a wide variety of applications can be made with the apparatus of FIG. 7-10.

The various embodiments herein provide an improved, more durable and higher quality resilient structure having coil springs located inside a fiber batt. Using the devices and methods described herein, the coil springs are disposed in the fiber batt with a minimal amount of melt impact to the fiber strands in the fiber batt. Further, a resilient structure has fiber strands interlayered and locking with the turn or turns of the coil spring. Thus, the structural integrity of the fiber batt is maintained around the coil. Such a resilient structure has the advantages of improved strength and support characteristics, improved coil spring support within the fiber batt, less susceptibility to coil spring noise, a reduction in compression loss and a reduction in coil spring fatigue that increases the durability of the structure. The resilient structure described herein is especially useful as a seat foundation and can be adapted for use in cushions, mattresses, etc.

Using the devices and methods described herein, resilient structures can be made from both knotted and unknotted coil springs having constant diameter turns or different diameter turns. There is no limitation on the type of coil that can be used. Further, no change in tooling is necessary to move from one type of coil to another, and the different types of coils can be used with the same equipment. Thus, a wide variety of resilient structures can be made at no additional cost.

The devices and methods described herein can be practiced either manually or automatically without any significant difference in quality of the final resilient structure. Therefore, the devices and methods herein can be adapted to a wide variety of markets that have significant differences in the availability and cost of labor. If full automation is desired, the resilient structures described herein can be made with machinery and processes that are less complex, more reliable and less expensive than the equipment used to make known resilient structures.

While the invention has been illustrated by the description of one embodiment and while the embodiment has been described in considerable detail, there is no intention to restrict nor in any way limit the scope of the appended claims to such detail. Additional advantages and modifications will readily appear to those who are skilled in the art. For example, the gripper and rotation actuators are described as pneumatic cylinders. As will be appreciated, in other embodiments, the actuators may be electrically operated or other devices that are effective to achieve the desired operation.

In the described embodiment, resistance heating is utilized to heat the coil springs 14*b*; however, as will be appreciated, in other embodiments, other heating methods may be used. Further, as will be appreciated, alternative embodiments described with respect to one of the embodiments herein may also be applied to other of the embodiments. For example, the coil springs are shown as being inserted through side wall of a fiber batt strip; however, in other applications, the coil springs may be inserted through other walls of the fiber batt strip. Further, the coils may be inserted one at a time or in parallel.

Further, in the described embodiment of FIG. 7, a drive belt 96 is mounted over the fiber batt strip 86; and as will be appreciated, in other embodiments, the drive belt 96 can be mounted on a side or bottom of the fiber batt strip 96. In addition, other devices for conveying the fiber batt strip can be used.

In the described embodiment, the coil spring insertion devices 100 move the coil springs along a curvilinear path of about 90° in order to insert the coil springs in the fiber batt strip. That embodiment has an advantage of providing easier access for manually loading coil springs in the insertion devices 100. However, as will be appreciated, in other applications, a coil spring material handling device may have greater flexibility in how the coil springs are inserted in the fiber batt. In those applications, the coil spring insertion devices 100 may have a linear reciprocating motion that inserts the coils along a linear path into the fiber batt. Further, the direction of motion of the insertion path may be perpendicular to a side surface of the fiber batt or may be oblique to the fiber batt side surface.

Therefore, the invention in its broadest aspects is not limited to the specific details shown and described. Consequently, departures may be made from the details described herein without departing from the spirit and scope of the claims which follow.

What is claimed is:

1. A method of forming a resilient structure for supporting a load comprising:

providing a first fiber batt strip having first and second surfaces defining a thickness of the first fiber batt strip, the first surface adapted to support the load, and a third surface extending between the first and second surfaces; and heating a first coil spring having a first centerline to provide a heated first coil spring;

providing relative motion between the heated first coil spring and the first fiber batt strip to move the heated first coil spring in a direction substantially perpendicular to the first centerline and through the third surface and to a desired location within the first fiber batt strip while maintaining the longitudinal centerline of the first coil spring substantially perpendicular to the first and second surfaces;

providing a second fiber batt strip having fourth and fifth surfaces defining a thickness of the second fiber batt strip, the fourth surface adapted to support the load, and a sixth surface extending between the fourth and fifth surfaces of the second fiber batt strip;

heating a second coil spring having a second centerline to provide a heated second coil spring;

providing relative motion between the second coil spring and the second fiber batt strip to move the heated second coil spring in a direction substantially perpendicular to the second centerline and against and through the sixth surface and to a desired location within the second fiber batt strip while maintaining the longitudinal centerline of the second coil spring substantially perpendicular to the fourth and fifth surfaces of the second fiber batt strip; and joining the first fiber batt strip and the second fiber batt strip to form a unitary resilient structure.

2. The method of claim 1 further comprising joining the third surface of the first fiber batt with the sixth surface of the second fiber batt.

3. A method of making a resilient structure comprising:

presenting a first side surface of a fiber batt;

heating a first coil spring having a first centerline;

moving the first coil spring in a direction substantially perpendicular to the first centerline to insert the first coil spring through the first side surface and into the fiber batt;

cutting the fiber batt to a desired length to provide a first fiber batt strip having the first coil spring contained therein;

presenting another side surface of the fiber batt;

heating a second coil spring;

moving the second coil spring in a direction substantially perpendicular to the first centerline to insert the second coil spring through the other side surface and into the fiber batt;

cutting the fiber batt to a desired length to provide a second fiber batt strip having the second coil spring contained therein; and joining the first fiber batt strip and the second fiber batt strip to produce the resilient structure.

* * * * *